US005472352A

United States Patent [19]

Nishide et al.

[11] Patent Number: 5,472,352

[45] Date of Patent: Dec. 5, 1995

[54] WATERPROOFING ASSEMBLY FOR CONNECTOR

[75] Inventors: Satoru Nishide; Mitsuhiro Fujitani, both of Yokkaichi, Japan

[73] Assignee: Sumitomo Wiring Systems, Ltd., Japan

[21] Appl. No.: 337,750

[22] Filed: Nov. 14, 1994

[30] Foreign Application Priority Data

Nov. 24, 1993 [JP] Japan ..... 5-067565 U

[51] Int. Cl.[6] ..... H01R 13/52

[52] U.S. Cl. ..... 439/274; 439/587

[58] Field of Search ..... 439/271, 272, 439/273, 274, 278, 426, 519–521, 752, 587–589

[56] References Cited

U.S. PATENT DOCUMENTS 4,109,989 8/1978 Snyder, Jr. et al. ..... 439/274 X
4,740,169 4/1988 Gordon ..... 439/521 X
4,950,175 8/1990 Plyler et al. ..... 439/274
5,240,433 8/1993 Kato ..... 439/279 X

FOREIGN PATENT DOCUMENTS 57-62384 4/1982 Japan .

*Primary Examiner*—Khiem Nguyen
*Attorney, Agent, or Firm*—Jordan B. Bierman; Bierman and Muserlian

[57] ABSTRACT

This invention provides a waterproofing assembly for a connector a housing of which is completely waterproofed. A rear rubber plug 39 is press-fitted in a rear cylindrical portion 28 of a housing 20 in which a female terminal metal fixture 30 connected to an electrical wire 38 is accommodated. A cap 50 is mounted on a front cylindrical portion 21 of the housing 20 while a front rubber plug 40 is press-fitted in the front cylindrical portion 21. The front rubber plug 40 has first and second cylindrical portions 41 and 44 and a uniting portion 45 for sealingly coupling the portions 41 and 44. A rib 53 formed in the cap 50 is press-fitted in a clearance 43 in the front rubber plug 40 so that the cap 50 covers the front cylindrical portion 21.

5 Claims, 4 Drawing Sheets

WATERPROOFING ASSEMBLY FOR CONNECTOR

BACKGROUND OF THE INVENTION (1) Field of the Invention

This invention relates to a waterproofing assembly which waterproofs a cylindrical body such as a connector housing and the like.

(2) Statement of the Prior Art

For convenience of explanation, a conventional connector will be described below by referring to FIGS. 7 and 8. FIG. 7 is an exploded perspective view of a conventional connector and FIG. 8 is a longitudinal sectional view of the connector shown in FIG. 7, illustrating a process of fitting the connector.

In FIG. 7, a connector 1 includes a box like housing 2 and a female terminal metal fixture 6 which is accommodated in the housing 2 and connected to an electrical cable 7.

More particularly, the housing 2 is provided on its front and rear sides (left and right sides in the drawing) with an insertion port 3 for a male terminal metal fixture 100 (FIG. 8) and an insertion port 4 for the female terminal metal fixture 6. The housing 2 is also provided in its interior with a terminal accommodating chamber 5. The female terminal metal fixture 6 is inserted through the insertion port 4 into the chamber 5.

As shown in FIG. 8, the male terminal metal fixture 100 electrically connected to a device 101 is inserted through the insertion port 3 into the housing 2 so that the fixture 100 is fitted to the fixture 6.

In the conventional connector 1 described above, since the insertion port 3 which communicates with the chamber 5 in the housing 2 is exposed outwardly, water may enter the chamber 5 through the port 3 to corrode the fixture 6 in the chamber 5.

It will be possible to waterproof the connector 1 by attaching a cap to the front end of the housing 2 when the connector 1 is not used. However, the cap must be detached from the housing when the connector 1 is used. This will make handling of the connector troublesome.

SUMMARY OF THE INVENTION

An object of the present invention is to provide a waterproofing assembly for a connector, which can completely and easily waterproof a connector housing and the like.

In order to achieve the above object, the present invention is applied to a waterproofing assembly for a connector which has a cylindrical housing accommodating a first thin plate like terminal metal fixture and a second terminal metal fixture adapted to be detachably coupled to the first terminal metal fixture. The waterproofing assembly of the present invention comprises: a front rubber plug adapted to be sealingly press-fitted in a front opening end portion of the housing, the plug including a first cylindrical portion having a slit to allow the first terminal metal fixture to pass through, a second cylindrical portion provided around the first cylindrical portion, and a uniting portion for sealingly interconnecting the first and second cylindrical portions; a cap including an insertion port adapted to receive the first terminal metal fixture and a rib projecting from an outer periphery of the insertion port to an interior of the cap, the cap being adapted to cover the front opening end portion of the housing when the rib is inserted into a clearance between the first and second cylindrical portions to sealingly close the slit; and a rear rubber plug adapted to be sealingly press-fitted in a rear opening end portion of the housing, the rear rubber plug holding an electrical wire connected to the second terminal metal fixture.

In the waterproofing assembly for the connector constructed above, since the housing is provided on its front end with the waterproofing construction, the front opening end of the housing is sealed even if the first terminal metal fixture is not inserted into the insertion port in the cap. Further, since the electrical cable which is connected to the second terminal metal fixture accommodated in the housing sealingly passes through the rear rubber plug and the plug is sealingly press-fitted to the rear opening end, the housing is sealed.

Upon use of the connector, the first terminal metal fixture is inserted into the housing while widening the first cylindrical portion and it sealingly contacts with the first terminal metal fixture by its elasticity when the first terminal metal fixture is fitted to the front end of the second terminal metal fixture.

As described above, since the front opening end of the cylindrical body is sealed upon non insertion and insertion of the first terminal metal fixture, water does not enter the cylindrical body through the front opening end upon non insertion and insertion of the fixture. The front end of the cylindrical body can effect the waterproofing completely and easily.

Also, since the front and rear rubber plugs can seal the front and rear ends of the cylindrical body which accommodates the second terminal metal fixture, water is prevented from entering the connector upon non insertion and insertion of the second terminal metal fixture, thereby perfectly and readily waterproofing the connector. Consequently, it is possible to enhance a performance and reliability of the connector.

In addition, in the case that the waterproofing assembly for the connector is not required, the front and rear rubber plugs may be detached from the cylindrical body. Accordingly, the same waterproofing assembly can be used upon both waterproofing and non waterproofing conditions.

DETAILED DESCRIPTION OF THE PREFERRED EMBODIMENTS

Figure 1:
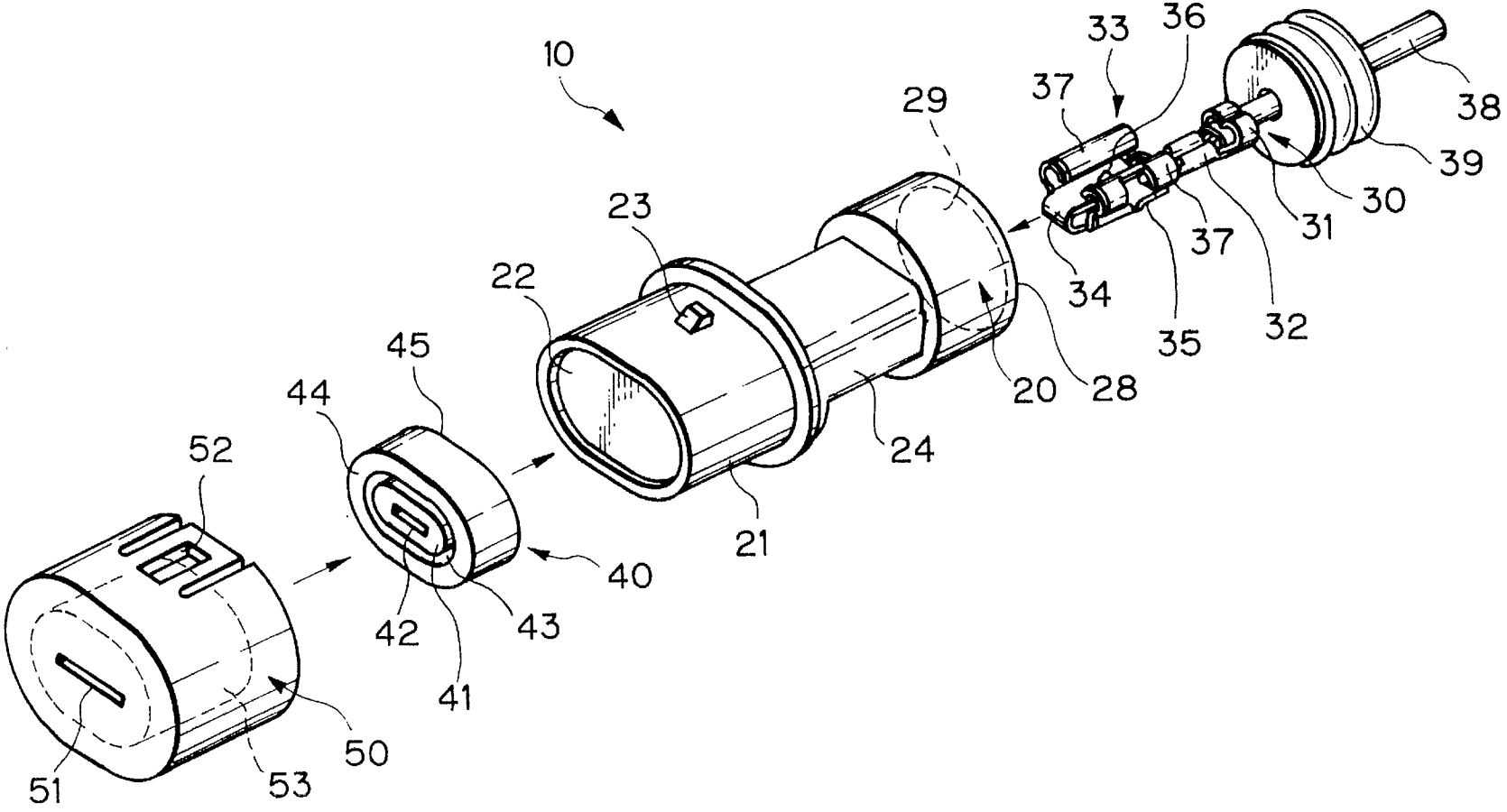
FIG. 1 is an exploded perspective view of an embodiment of a waterproofing assembly for a connector in accordance with the present invention.
Figure 2:
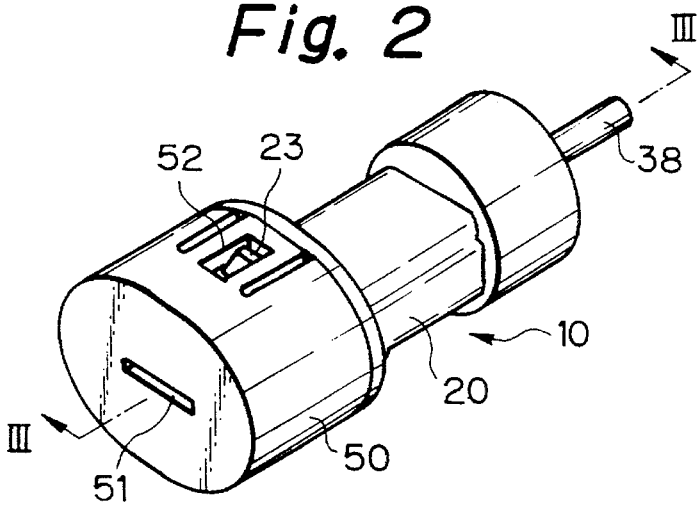
FIG. 2 is a perspective view of the assembly shown in FIG. 1, illustrating the assembly in a constructed state.

By referring now to the drawings, embodiments of a waterproofing assembly for a connector in accordance with the present invention will be explained below.

In FIGS. 1 through 4, "a front side" hereinafter described is a left side while "a rear side" is a right side.

As shown in FIG. 1, a waterproofing assembly 10 for a connector comprises a front rubber plug 40, a cap 50, a housing 20, and a rear rubber plug 39 which holds a female terminal metal fixture 30 to be accommodated in the housing 20.

The housing 20 consists of a cylindrical united body and is provided on its front side with a front cylindrical portion 21, on its middle position with a base portion 24 contiguous to the front cylindrical portion 21, and on its rear side with a rear cylindrical portion 28 contiguous to the base portion 24.

The front cylindrical portion 21 has an opening 22 being large enough to receive the front rubber plug 40 compressively and is provided on its upper and lower faces with a projection 23 for locking the cap 50.

Figure 3:
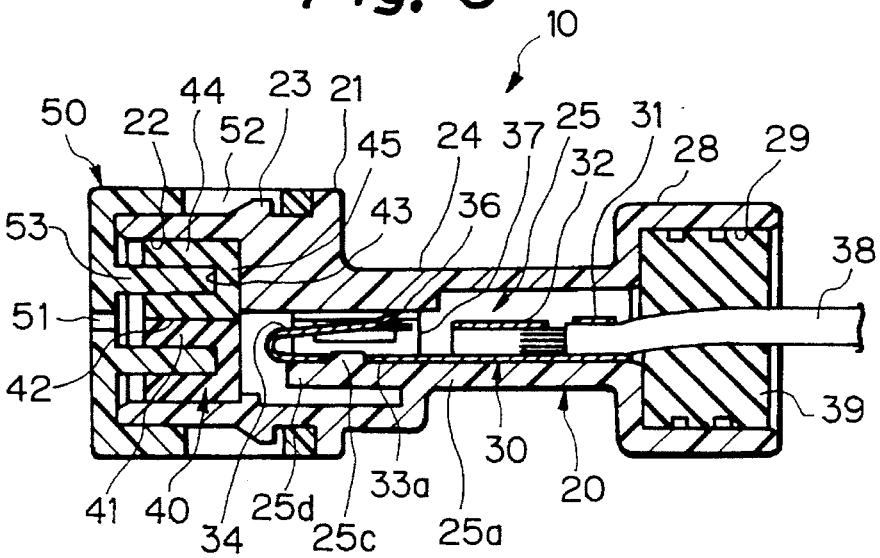
FIG. 3 is a longitudinal sectional view taken along lines III—III in FIG. 2.

As shown in FIG. 3, the base portion 24 has a terminal accommodating chamber 25 for the female (second) terminal metal fixture 30 in communication to the opening 22 in the front cylindrical portion 21.

Figure 4:
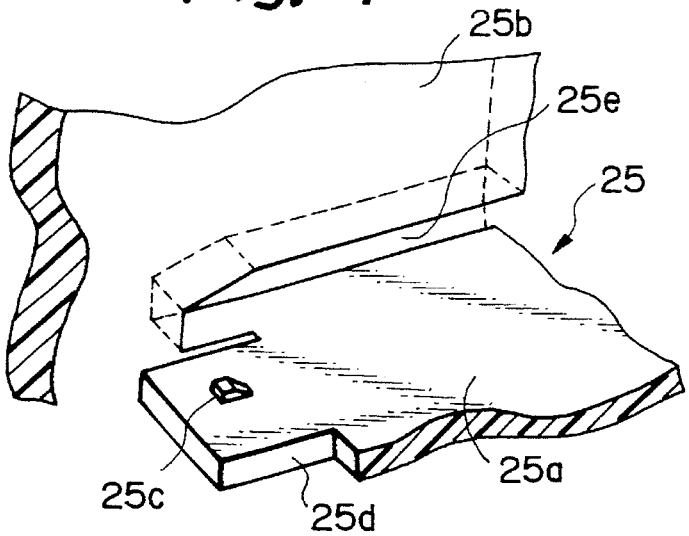
FIG. 4 is a perspective view of a terminal-accommodating chamber of a housing, illustrating the chamber in a partially broken-away state.

More particularly, as shown in FIG. 4, a bottom wall 25*a* which supports the female (second) terminal metal fixture 30 and side walls 25*b* define the terminal accommodating chamber 25. The bottom wall 25*a* is provided on an upper face on its front end with a projection 25*c* adapted to engage with the female terminal metal fixture 30 and on its front end with a deflectable lance 25*d*. The opposite side walls 25*b* is provided with a guide passage 25*e* adapted to slidably receive a wing 35 (described below) of the fixture 30.

The rear cylindrical portion 28 has a diameter being larger than that of the base portion 24, receives the female (second) terminal metal fixture 30 through an insertion port 29 for the female (second) terminal metal fixture 30 and then receives the rear rubber plug 39 compressively.

The female terminal metal fixture 30 to be accommodated in the housing 20, as shown in FIG. 1, has a terminal portion 33 at its front end and is connected to an electrical cable 38 at its rear end.

The terminal 33 includes a U-shaped tongue piece 34 and front end of which is bent rearwardly and a pair of round press pieces 37 which are formed by bending each side of the front end inwardly. The tongue piece 34 is provided on its opposite sides with a wing 35 adapted to slidably engage with the guide passage 25*e* in the chamber 25 and on its upper face with a projection 36 adapted to engage with a male (first) terminal metal fixture 100 (described hereinafter). As shown in FIG. 3, the terminal portion 33 is provided on its lower face with an aperture 33*a* adapted to engage with the projection 25*c* on the lance 25*d*.

As shown in FIGS. 1 and 3, an end portion of the electrical cable 38 is crimped in an insulation barrel 31 of the female terminal metal fixture 30 while conductor wires exposed from the end of the electrical cable 38 are crimped in a wire barrel 32.

The electrical cable 38 is sealingly inserted through the rear rubber plug 39. An outer diameter of the rear rubber plug 39 is set to be slightly larger than the insertion port 29 for the female terminal metal fixture 30. The rear rubber plug 39 can be press-fitted to the rear cylindrical portion 28 through the insertion port 29.

The female terminal metal fixture 30 is inserted into the terminal accommodating chamber 25 through the insertion port 29 of the rear cylindrical portion 28 and is guided into the inner part of the chamber 25 while the opposite guide passages 25*b* are guiding the wings 35 of the fixture 30. When the aperture 33*a* in the terminal portion 33 receives the projection 25*c* on the lance 25*d*, the fixture is disposed on the bottom wall 25*a*.

When the female terminal metal fixture 30 is accommodated in the housing 20, the rear rubber plug 39 is press-fitted to the rear cylindrical portion 28. Thus, the rear cylindrical portion 28 is sealed by the plug 39 to waterproof the rear portion of the housing 20.

On the other hand, the front rubber plug 40 and cap 50 waterproof the front side of the housing 20.

Such waterproofing construction will be explained below.

As shown in FIGS. 1 and 3, the front rubber plug 40 includes a first cylindrical portion 41 with a slit 42 and a second cylindrical portion 44 disposed coaxially and with a given clearance 43 around the first cylindrical portion 41.

These first and second cylindrical portions 41 and 44 have the same length and are sealingly interconnected at their rear ends by a uniting portion 45. An exterior configuration of the second cylindrical portion 44 coincides with an interior configuration of the opening 22 in the front cylindrical portion 21 of the housing 20. An outer diameter of the second cylindrical portion 44 is slightly larger than an inner diameter of the opening 22 so that the front rubber plug 40 is compressively inserted into the front cylindrical portion 21.

The cap 50 is formed into a cylindrical body to cover the front cylindrical portion 21 of the housing 20. The cap 50 is provided at a center on a front wall with a narrow elongate port 51 adapted to receive a male (first) terminal metal fixture 100 (see FIG. 5) and on upper and lower faces with an aperture 52 adapted to engage with the projection 23 on the front cylindrical portion 21.

The cap 50 is provided in its interior with an annular rib 53 which encloses the insertion port 51 for the male (first) terminal metal fixture 100 and extends rearwardly. The annular rib 53 coincides with an annular clearance 43 in the front rubber plug 40 and has a slightly greater thickness than a width of the clearance 43 so that the annular rib 53 can enter the annular clearance 43 compressively.

The front rubber plug 40 and cap 50 are attached to the interior and exterior of the front cylindrical portion 21.

As shown in FIG. 3, the front rubber plug 40 is press-fitted into the front cylindrical portion 21 with the front faces of the first and second cylindrical portions 41 and 44 being opposed to the opening 22. Thus, the outer periphery of the second cylindrical portion 44 contacts with the inner periphery of the front cylindrical portion 21 compressively and sealingly, thereby waterproofing the interior of the portion 21.

Then, the rib 53 of the cap 50 is press-fitted into the clearance 43 in the front rubber plug 40 and the aperture 52 receives the projection 23 so that the cap 50 covers the front cylindrical portion 21.

When the rib 53 is press-fitted to the clearance 43, the first cylindrical portion 41 is compressed to sealingly close the center hole 42. This sealing closure of the center hole 42 effects the waterproofing between the insertion port 51 for the male (first) terminal metal fixture 51 and the terminal accommodating chamber 25.

Next, an operation of the above embodiment will be explained.

Figure 5:
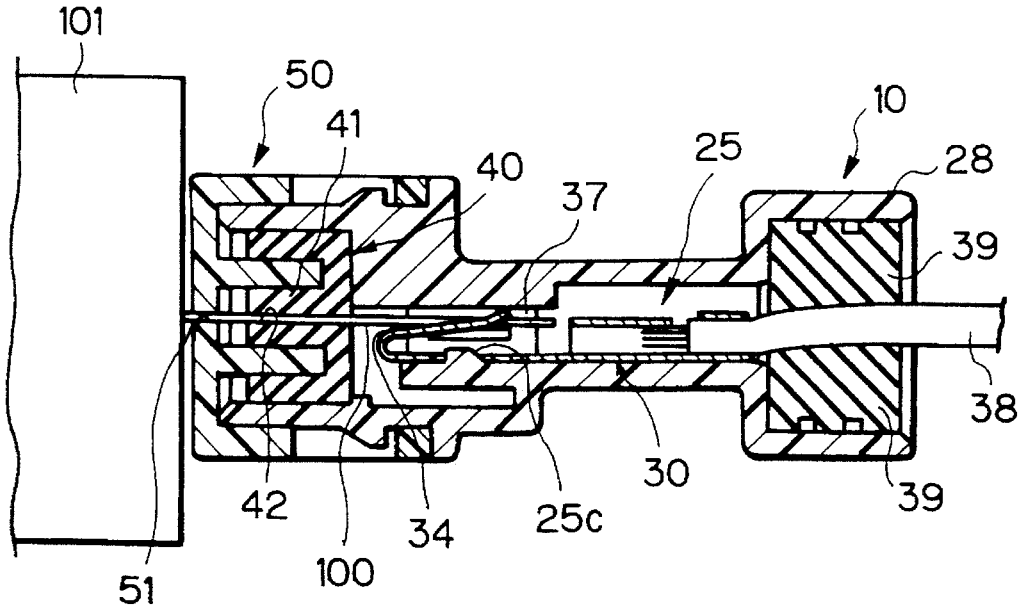
FIG. 5 is a longitudinal sectional view of the assembly, illustrating female and male connectors in a fitted position.
Figure 6:
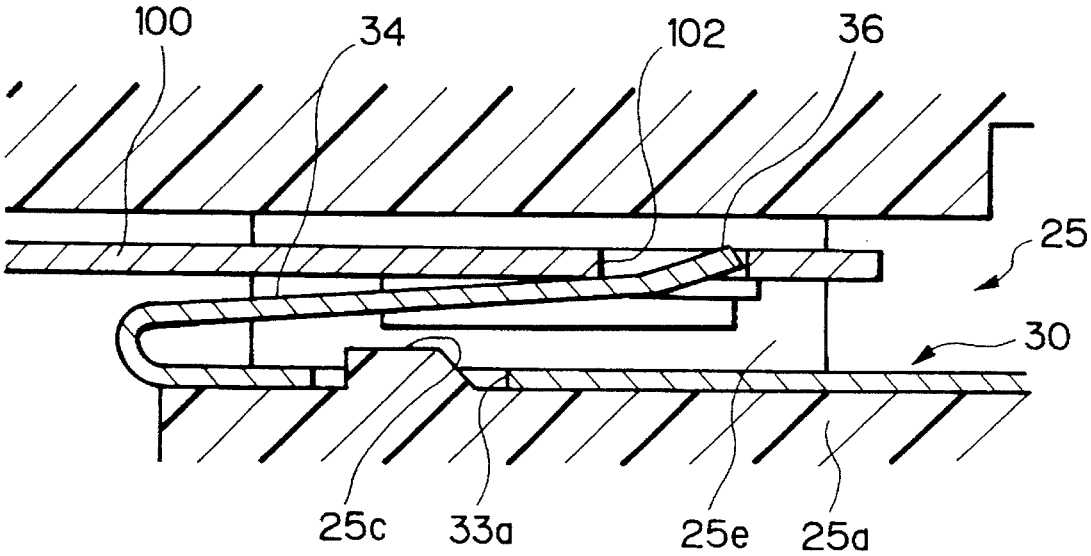
FIG. 6 is a fragmentary enlarged sectional view of FIG. 5, illustrating male and female terminal metal fixtures in a fitted position.
Figure 7:
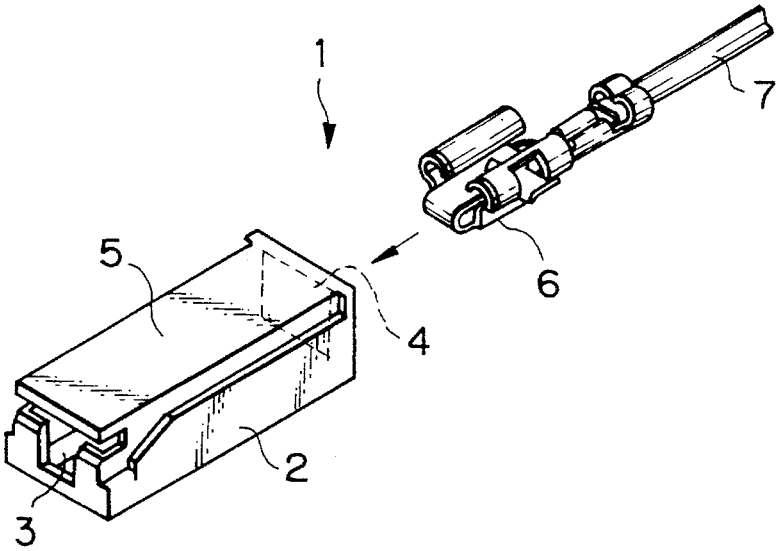
Fig. 7 PRIOR ART
FIG. 7 is an exploded perspective view of a prior connector.
Figure 8:
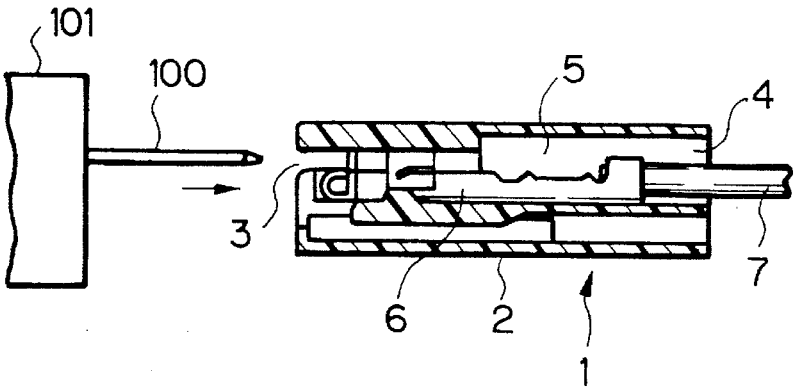
Fig. 8 PRIOR ART
FIG. 8 is a longitudinal sectional view of the prior connector, illustrating the connector in a position to be connected to a mating connector.

FIG. 5 shows longitudinal sectional view of the connector in use and FIG. 6 shows a fragmentary enlarged sectional view of the male and female terminal metal fixtures under their coupled position.

As shown in FIG. 3, upon non insertion of the male terminal metal fixture 100, the front rubber plug 40 is press-fitted to the front cylindrical portion 21 and the rib 53 is press-fitted in the clearance 43 in the front rubber plug 40 so that the cap 50 covers the front cylindrical portion 21. Consequently, the outer periphery of the second cylindrical portion 44 sealingly contacts with the inner periphery of the front cylindrical portion 21 and the first cylindrical portion 41 is compressed to sealingly close the center hole 42.

Since water on the outside is prevented by the front rubber plug 40 from entering the terminal accommodating chamber 25 through the insertion port 51 for the male terminal metal fixture 100, the female terminal metal fixture 30 is not corroded in the chamber 25 by water.

On the other hand, since the rear rubber plug 39 is press-fitted to the rear cylindrical portion 28 in the rear side of the housing 20 and the housing 20 is sealed from the rear cylindrical portion 28, water in the outside cannot enter the chamber 25 through the rear side of the housing 20.

Upon insertion of the male terminal metal fixture 100, as shown in FIG. 5, the male terminal metal fixture 100 electrically connected to the device 101 is inserted into the connector through the insertion port 51.

When the fixture 100 is advancing in the connector, the distal end of the fixture 100 reaches the closed center hole 42 in the front rubber plug 40. When the male terminal metal fixture 100 is forcibly press-fitted into the closed center hole 42, the hole 42 is opened by the fixture 100 so that the inner periphery of the first cylindrical portion 41 closely contacts with the fixture 100 by its elasticity.

Further, when the fixture 100 is advancing in the hole 42, the distal end of the fixture 100 reaches the tongue piece 34 of the female terminal metal fixture 30 and advances along the underside of the press portion 37 into the chamber 25 while deflecting the tongue piece 34 downwardly.

As shown in FIG. 6, the projection 36 on the tongue piece 34 engages with the aperture 102 in the end of the fixture 100 is caused from advancing in the chamber 25.

Thus, the male terminal metal fixture 100 is coupled to the female terminal metal fixture 30 and clamped between the upper face of the tongue piece 34 and the lower edge of the press portion, thereby bringing the fixtures 100 and 30 into electrical connection.

Upon the electrical connection of the fixtures 100 and 30, as shown in FIG. 5, the first cylindrical portion 41 compressively contacts with the fixture 100 and the rear rubber plug 39 is press-fitted to the rear cylindrical portion 28 of the housing 20. Accordingly, water on the outside cannot enter the housing 20.

In the case where the waterproofing assembly 10 for the connector is used in an atmosphere unnecessary to waterproof the connector, the front and rear rubber plugs 40 and 39 are detached from the assembly 10.

According to the waterproofing assembly for the connector, since the front and rear rubber plugs 40 and 39 can seal the front and rear sides of the housing 20 while either using or not using the assembly 10, it is possible to prevent the female terminal metal fixture 30 in the housing 20 from being corroded, thereby enhancing the performance and reliability of the assembly 10.

Further, in the case where the waterproofing assembly 10 is used under an atmosphere unnecessary to waterproof the connector, since the front and rear rubber plugs 40 and 39 can be detached from the assembly 10, the same waterproofing assembly can be used for waterproofing use and non waterproofing use.

What is claimed is:

1. A waterproofing assembly for a connector which has a cylindrical housing accommodating a first thin plate like terminal metal fixture and a second terminal metal fixture adapted to be detachably coupled to said first terminal metal fixture, comprising:

a front rubber plug adapted to be sealingly press-fitted in a front opening end portion of said housing, said plug including a first cylindrical portion having a slit to allow said first terminal metal fixture to pass through, a second cylindrical portion provided around said first cylindrical portion, and a uniting portion for sealingly interconnecting said first and second cylindrical portions;

a cap including an insertion port adapted to receive said first terminal metal fixture and a rib projecting from an outer periphery of said insertion port to an interior of said cap, said cap being adapted to cover said front opening end portion of said housing when said rib is inserted into a clearance between said first and second cylindrical portions to sealingly close said slit; and a rear rubber plug adapted to be sealingly press-fitted in a rear opening end portion of said housing, said rear rubber plug holding an electrical wire connected to said second terminal metal fixture.

2. A waterproofing assembly according to claim 1, wherein said first terminal metal fixture is a male terminal metal fixture and said second terminal metal fixture is a female terminal metal fixture.

3. A waterproofing assembly according to claim 1, wherein said housing consists of a cylindrical united body and is provided on its front side with a front cylindrical portion, on its middle position with a base portion contiguous to said front cylindrical portion, and on its rear side with a rear cylindrical portion contiguous to said base portion, wherein said front cylindrical portion has an opening being large enough to receive said front rubber plug compressively and is provided on its upper and lower faces with a projection for locking said cap, wherein said base portion has a terminal accommodating chamber for said second terminal metal fixture in communication to said opening in said front cylindrical portion, wherein said rear cylindrical portion has a diameter being larger than that of said base portion, receives-said second terminal metal fixture through an insertion port for said second terminal metal fixture and then receives said rear rubber plug compressively.

4. A waterproofing assembly according to claim 1, wherein said front rubber plug includes a first cylindrical portion with a slit and a second cylindrical portion disposed coaxially and with a given clearance around said first cylindrical portion, wherein said first and second cylindrical portions have the same length and are sealingly interconnected at their rear ends by a uniting portion, wherein an exterior configuration of said second cylindrical portion coincides with an interior configuration of said opening in a front cylindrical portion of said housing, and wherein an outer diameter of said second cylindrical portion is slightly larger than an inner diameter of said opening so that said front rubber plug is compressively inserted into said front cylindrical portion.

5. A waterproofing assembly according to claim 1, wherein said cap is formed into a cylindrical body to cover a front cylindrical portion of said housing, wherein said cap is provided at a center on a front wall with a narrow elongate port adapted to receive said first terminal metal fixture and on upper and lower faces with an aperture adapted to engage with a projection on said front cylindrical portion, wherein said cap is provided in its interior with an annular rib which encloses said insertion port for said first terminal metal fixture and extends rearwardly, and wherein said annular rib coincides with an annular clearance in said front rubber plug and has a slightly larger thickness than a width of said clearance so that said annular rib can enter said annular clearance compressively.

* * * * *